US005774162A

United States Patent [19]

Fukuda

[11] Patent Number: 5,774,162

[45] Date of Patent: Jun. 30, 1998

[54] COLOR THERMAL PRINTING METHOD FOR REDUCING DISPLACEMENT OF COLOR REGISTRATIONS AND AN APPARATUS THEREFORE

[75] Inventor: Hiroshi Fukuda, Saitama, Japan

[73] Assignee: Fuji Photo Film Co., Ltd., Kanagawa, Japan

[21] Appl. No.: 650,548

[22] Filed: May 20, 1996

Related U.S. Application Data

[63] Continuation of Ser. No. 132,961, Oct. 5, 1993, abandoned.

[30] Foreign Application Priority Data

Oct. 5, 1992 [JP] Japan ..... 4-266243

[51] Int. Cl.[6] ..... B41J 2/325; B41J 11/00; B41J 33/00

[52] U.S. Cl. ..... 347/175

[58] Field of Search ..... 347/172, 174, 347/175, 212, 218, 185, 186, 187; 400/120.03, 120.08, 120.07

[56] References Cited

U.S. PATENT DOCUMENTS

| | | | |
|---|---|---|---|
| 4,734,704 | 3/1988 | Mizutani et al. | 349/175 |
| 4,806,950 | 2/1989 | Sekine et al. | 347/185 |
| 5,019,836 | 5/1991 | Iwata et al. | 347/186 |
| 5,095,316 | 3/1992 | Hakkaku | 347/172 |
| 5,177,499 | 1/1993 | Yoshida et al. | 347/186 |

FOREIGN PATENT DOCUMENTS

| | | | |
|---|---|---|---|
| 153045 | 5/1992 | Japan | 347/175 |

*Primary Examiner*—N. Le
*Assistant Examiner*—L. Anderson

[57] ABSTRACT

A thermosensitive color recording paper is provided having a cyan thermosensitive coloring layer, a magenta thermosensitive coloring layer, and a yellow thermosensitive coloring layer, respectively laminated on a supporting material in this order. The thermosensitive color recording paper is placed on a platen drum which is rotated by a pulse motor via a timing belt in a subsidiary scan direction. During the rotation of the platen drum, the plane sequential thermal recording and light fixation of the thermosensitive color recording paper are performed by a thermal head. In thermally recording a pixel, each heating element of the thermal head generates a bias heat energy specific to each thermosensitive coloring layer followed by an image heat energy corresponding to the record density of the pixel. The platen drum starts rotating by the amount corresponding to one line at the timing of the start of generating the image heat energy or at the timing delayed by a predetermined time from the start of generating the image heat energy, so as to make the positions of color pixels coincide with each other.

26 Claims, 5 Drawing Sheets

COLOR THERMAL PRINTING METHOD FOR REDUCING DISPLACEMENT OF COLOR REGISTRATIONS AND AN APPARATUS THEREFORE

This application is a continuation of application Ser. No. 08/132,961 filed on Oct. 5, 1993, now abandoned.

BACKGROUND OF THE INVENTION

1. Field of the Invention

The present invention relates to a color thermal printing method, and more particularly to a color thermal printing method of recording an ink dot having a desired density on a recording paper by supplying a bias heat energy specific to color and an image heat energy determined by a density.

2. Description of the Related Art

Thermal recording includes thermal transfer recording in which ink as coating of an ink film is transferred to a recording paper, and thermosensitive recording in which a thermosensitive recording paper is heated directly to develop color. For example, in a color thermosensitive printer, a thermal head is made in contact with a color thermosensitive recording paper to record a full-color image on the paper by sequential three-color plane thermal recording. As described in U.S. Pat. No. 4,734,704 (corresponding to Japanese Patent Laid-open Publication No.61-213169), a thermosensitive color recording paper has cyan, magenta, and yellow thermosensitive coloring layers laminated on a supporting material in this order. The heat energy required for developing color differs between respective thermosensitive coloring layers for selective coloring of the thermosensitive layers. The lower the layer, the larger heat energy is required. The thermosensitive coloring layer having developed color is provided with radiation of an electromagnetic wave specific to this layer to optically fix the developed color, according to light fixation, in order not to change the color when the next lower thermosensitive layer is thermally recorded.

In developing color of each thermosensitive coloring layer, it is necessary to apply a coloring heat energy having a heat energy sufficient for starting coloring (hereinafter called bias heat energy), added to a heat energy for coloring to a desired density (hereinafter called image heat energy). A thermal head has a number of heating elements disposed on a main scan direction, each heating element being used for recording one ink dot. Each heating element is connected to the output terminal of an AND gate, which has two input terminals into which the outputs of a latch circuit and a strobe signal generator are supplied. When a strobe signal "1" is inputted after a drive data "1" is latched by the latch circuit, the heating element is powered while the strobe signal is applied.

Each heating element is therefore powered synchronously with the strobe signal. The strobe signal contains a bias strobe pulse having a wide pulse width for bias heating and image strobe pulses each having a narrow pulse width for image heating. One line recording cycle during which pixels of one line are recorded at the same time is formed by a bias heating period, an image heating period, and a cooling period. During the bias heating period, a bias strobe pulse is generated. During the image heating period, image strobe pulses corresponding in number to the tonal level of each pixel are generated at a predetermined time interval. During the cooling period, no strobe pulse is generated so as to cool the heating elements.

For a pixel having a high tonal level, the number of heating operations is large and a large image heat energy is generated by generating a large number of drive data "1" to be latched by the latch circuit. On the other hand, for a pixel having a low tonal level, the number of heating operations is small and a small image heat energy is generated by generating a small number of drive data "1" to be latched by the latch circuit.

As described above, the lower the thermosensitive coloring layer, the larger bias heat energy is required. As shown in FIG. 6, the bias heating periods for the thermosensitive coloring layers are $T_{BY}<T_{BM}<T_{BC}$, where $T_{BY}$ is the bias heating period for yellow, $T_{BM}$ is the bias heating period for magenta, and $T_{BC}$ is the bias heating period for cyan. The bias strobe pulse is generated synchronously with a line start signal, in the same manner as a motor drive pulse for starting the rotation of a platen drum. Because the bias heating period differs to a great extent between the respective thermosensitive coloring layers, the record start position for each color differs. The different record start positions result in deviated positions of the three color dots in the whole record area. With a conventional color thermal printing method, a displacement of color registrations is generated accordingly.

SUMMARY OF THE INVENTION

It is a principal object of the present invention to provide a color thermal printing method capable of reducing a displacement of color registrations.

It is another object of the present invention to provide a color thermal printing method capable of taking steps to reduce a displacement of color registrations with a simple method.

In order to achieve the above and other objects, the relative motion of a thermal head and a recording paper starts at the timing when the thermal head starts generating an image heat energy or after a predetermined time delay therefrom. The relative motion and thermal recording are synchronized in association to the start of generating the image heat energy so as to make the positions of color ink dots coincide with each other. In recording one ink dot, each heating element of the thermal head generates a bias heat energy followed by an image heat energy. The bias heating period is different for each color. The image heating period changes with the record density of each ink dot, but rarely changes with color. The thermal recording and relative motion may be synchronized for only the first line, but preferably for each line.

According to a preferred embodiment of the present invention, a recording paper has a cyan thermosensitive coloring layer, a magenta thermosensitive coloring layer, and a yellow thermosensitive coloring layer, respectively laminated on a supporting material in this order. The recording paper is placed on a platen drum which is driven by a pulse motor via a belt. The pulse motor is supplied with a motor drive pulse when the relative motion starts.

According to another preferred embodiment of the present invention, the platen drum starts its rotation at the timing of the middle point during the image heating period for each color. Even if the image heating period during one line differs to a great extent between colors, the positions of maximum densities of color ink dots are made coincident with each other, reducing a displacement of color registrations.

According to the embodiments of the present invention, the relative motion and thermal recording are synchronized with the timing associated with the generation of the image heat energy. Therefore, a displacement of color registrations to be caused by different bias heat energies between respective colors can be avoided and a print of a high image quality can be obtained.

BRIEF DESCRIPTION OF THE DRAWINGS

The above and other objects and advantages of the present invention will become apparent from the detailed description of the preferred embodiments when read in conjunction with the accompanying drawings, in which.

DETAILED DESCRIPTION OF THE PREFERRED EMBODIMENTS

Figure 1:
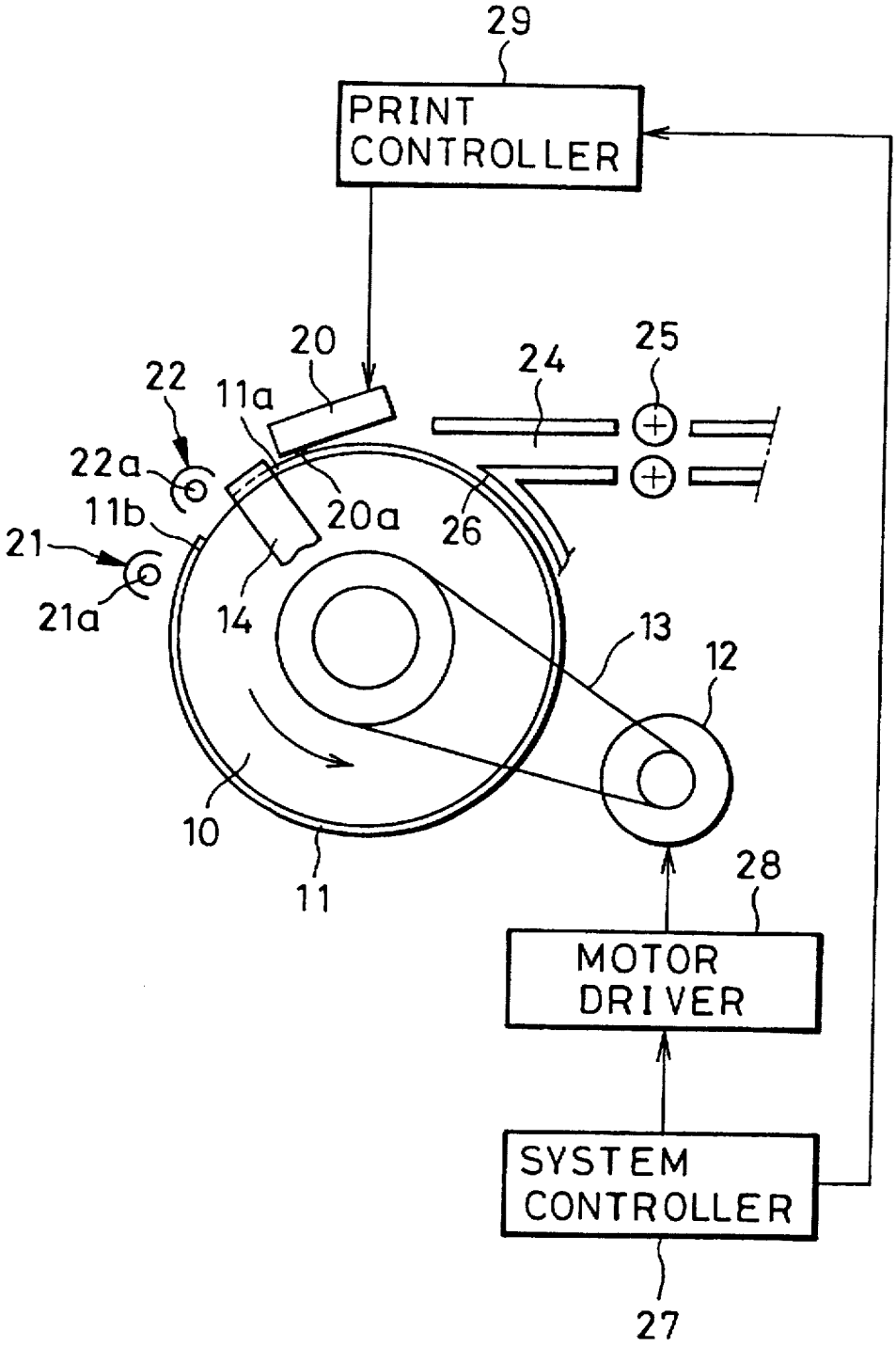
FIG. 1 is a schematic diagram showing a color thermal printer used for embodying the present invention.

Referring to FIG. 1, a platen drum 10 holds a thermosensitive color recording paper 11 on the outer circumference of the drum, and is rotated in the arrow direction (in the subsidiary scan direction) via a timing belt 13 by a pulse motor 12 during the thermal printing. A clamper 14 is mounted on the platen drum 10 to fix the thermosensitive color recording paper 11 at least at one position, e.g., at a leading edge 11*a* of the thermosensitive color recording paper 11. The pulse motor 12 is coupled via the timing belt 13 to the platen drum 10 so that the platen drum 10 rotates generally at a constant speed although the pulse motor 12 rotates stepwise.

On the outer peripheral side of the platen drum 10, there are mounted a thermal head 20 and first and second light-fixing devices 21 and 22. As is known and described in a copending U.S. patent application, the thermal head 20 has a number of heating elements 20*a* disposed linearly in the axial direction of the platen drum 10 (i.e. main scan direction). A first light-fixing device 21 has an ultraviolet lamp 21*a* of a stick shape having a light emission peak of about 420 nm. A second light-fixing device 22 has an ultraviolet lamp 22*a* of a stick shape having a light emission peak of about 365 nm.

A pair of transport rollers 25 are disposed on a paper feed/ejection path 24 through which the thermosensitive color recording paper 11 is transported. A separation claw 26 is provided at the paper feed/ejection path 24 on the platen drum side to guide the trailing edge of the thermosensitive color recording paper 11 when ejecting it. In this embodiment, one path is used for both the paper feeding and the paper ejection. A paper ejection path may be provided separately from a paper feed path.

Figure 5:
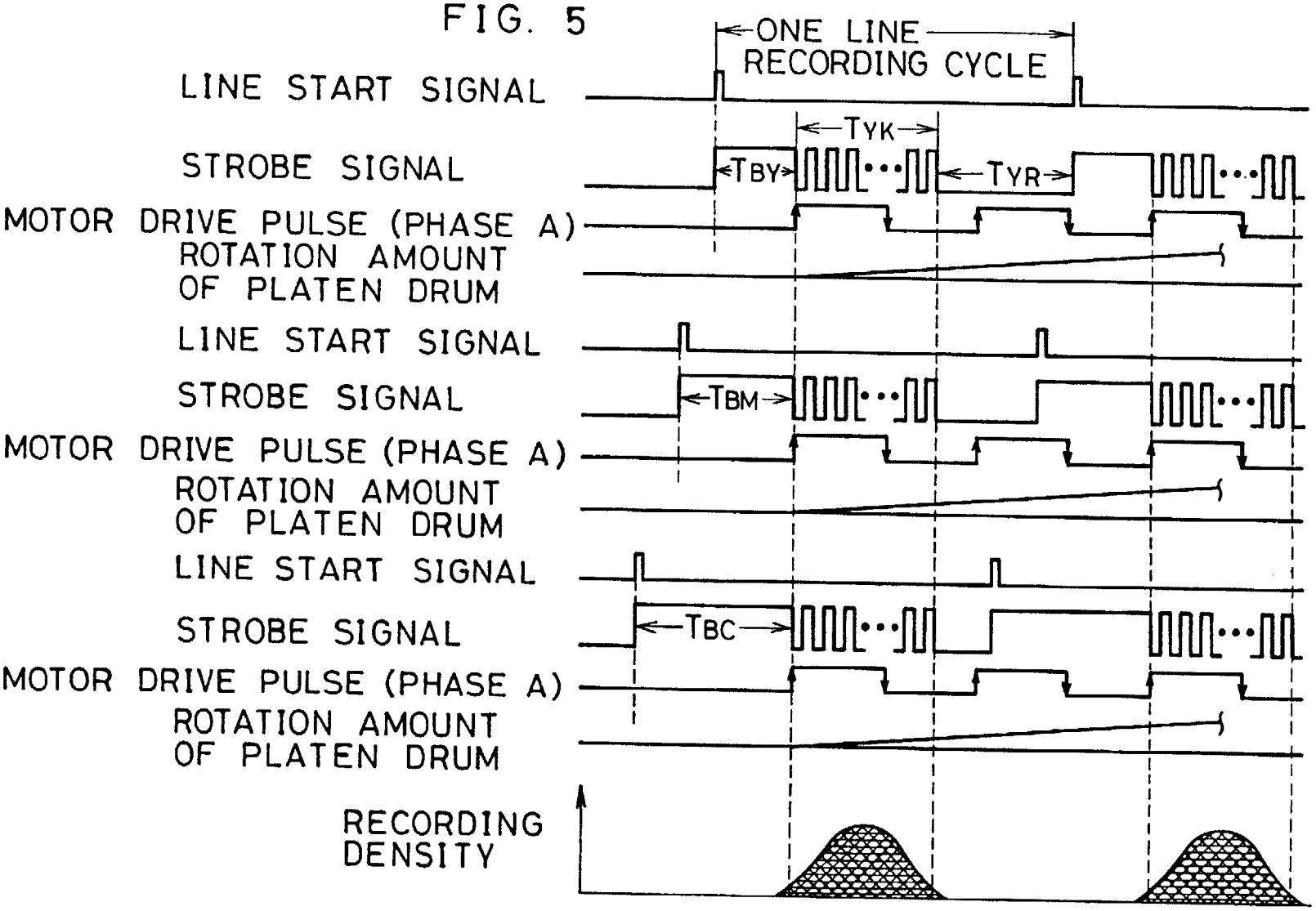
FIG. 5 is a timing chart explaining signal waveforms during the print operation by the photosensitive coloring layers and the relationship between the amount of rotation of a platen drum and the print density.
Figure 6:
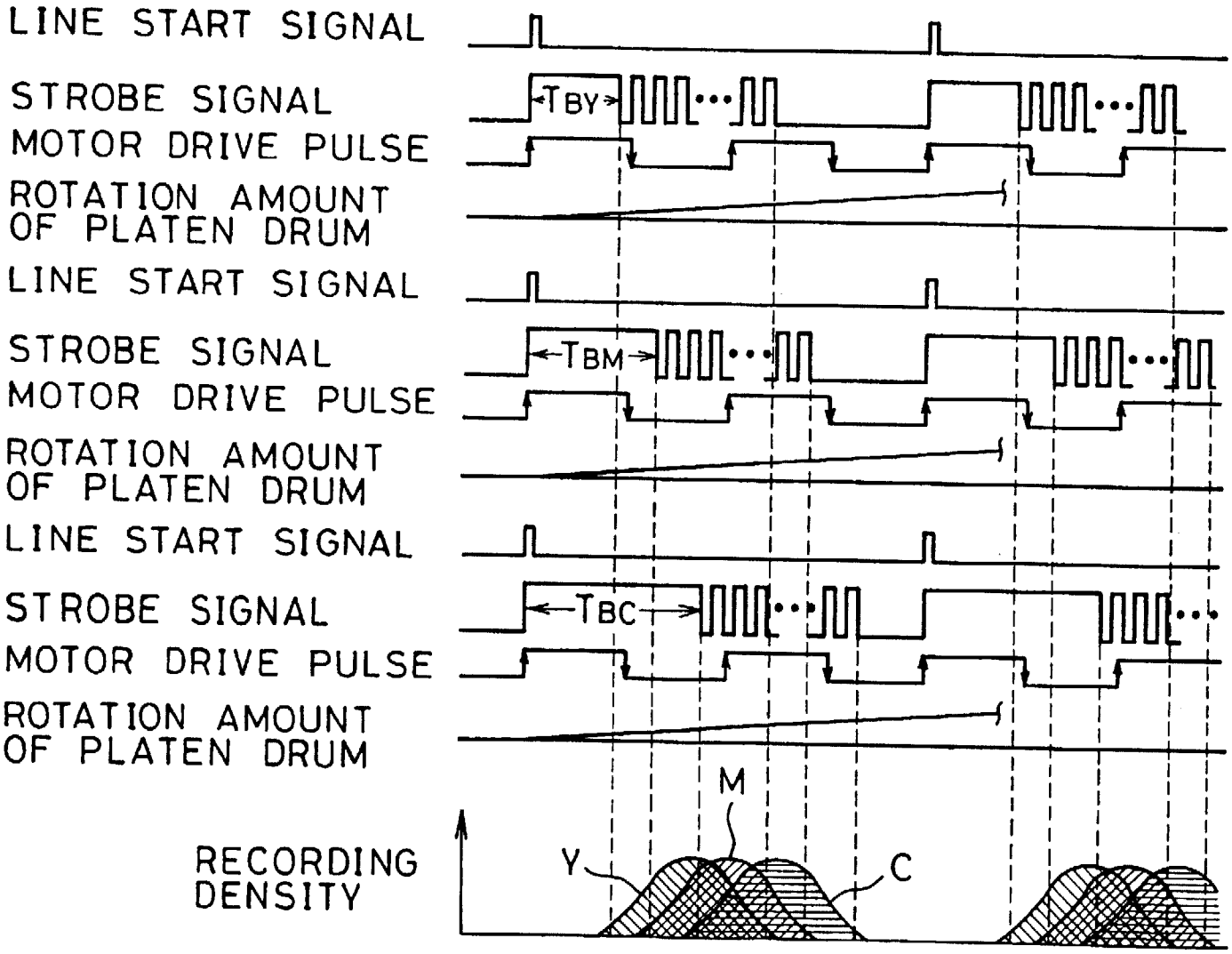
FIG. 6 (PRIOR ART)
FIG. 6 is a timing chart like that shown in FIG. 5 for a conventional color thermal printer.

The pulse motor 12 is controlled by a motor drive pulse supplied from a motor driver 28 under the control of a system controller 27. In this embodiment, as shown in FIG. 5, the platen drum 10 rotates by one line in response to four motor drive pulses. In FIG. 5, the A-phase signal waveform is shown instead of the motor drive pulse. The motor drive pulse is inputted to a decoder, and converted into signals of the Phase A and Phase B, which are supplied to stator coils of the pulse motor 12. At the rising and falling edges of the A-phase signal, the pulse motor 12 rotates by one step. The four motor drive pulses divide the one-line recording cycle into approximately four equal periods.

The thermal head 20 is driven by a strobe signal generated by a print controller 29 upon reception of a command signal from the system controller 27 (refer to FIG. 5). The strobe signal is formed by a bias strobe pulse and image strobe pulses. The bias strobe pulse is generated synchronously with a line start signal generated by the system controller 27. This line start signal is generated continuously at a predetermined time interval until completion of the recording of the whole record area of the thermosensitive color recording paper 11.

Figure 2:
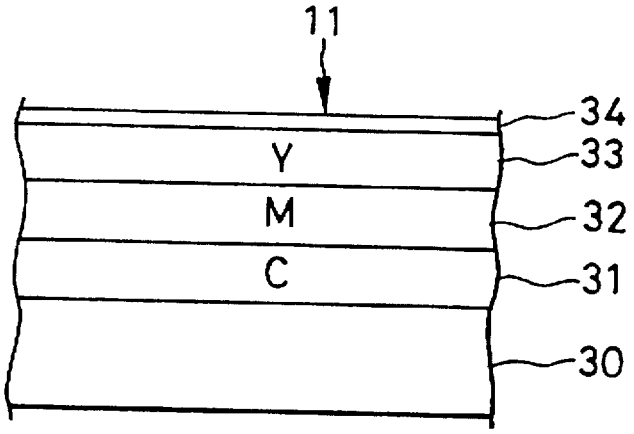
FIG. 2 is a diagram showing an example of the laminated structure of a photosensitive coloring paper.

FIG. 2 shows an example of a thermosensitive color recording paper. On a supporting material 30, there are formed a cyan thermosensitive coloring layer 31, a magenta thermosensitive coloring layer 32, a yellow thermosensitive coloring layer 33, and a protective layer 34 in this order. Intermediate layers are provided between adjacent coloring layers in practice, which are omitted in FIG. 2. As the supporting material 30, an opaque coat paper or a plastic film is used. A transparent plastic film is used for an OHP sheet for overhead projectors.

The cyan thermosensitive coloring layer 31 contains as its main components an electron-donor type dye precursor and an electron-acceptor type compound, and forms a cyan dye when heated. The magenta thermosensitive coloring layer 32 contains a diazonium salt compound having a maximum absorption wavelength of about 365 nm and a coupler which forms a magenta dye when it is thermally reacted with the diazonium salt compound. When an ultraviolet ray of about 365 nm is applied to the magenta thermosensitive coloring layer 32 after thermal printing, the diazonium salt compound is discomposed by light and loses a coloring ability.

The yellow thermosensitive coloring layer 33 contains a diazonium salt compound having a maximum absorption wavelength of about 420 nm and a coupler which forms a yellow dye when it is thermally reacted with the diazonium salt compound. When a near ultraviolet ray of about 420 nm is applied to the yellow thermosensitive coloring layer 33, it is fixed by light and loses a coloring capacity.

Figure 3:
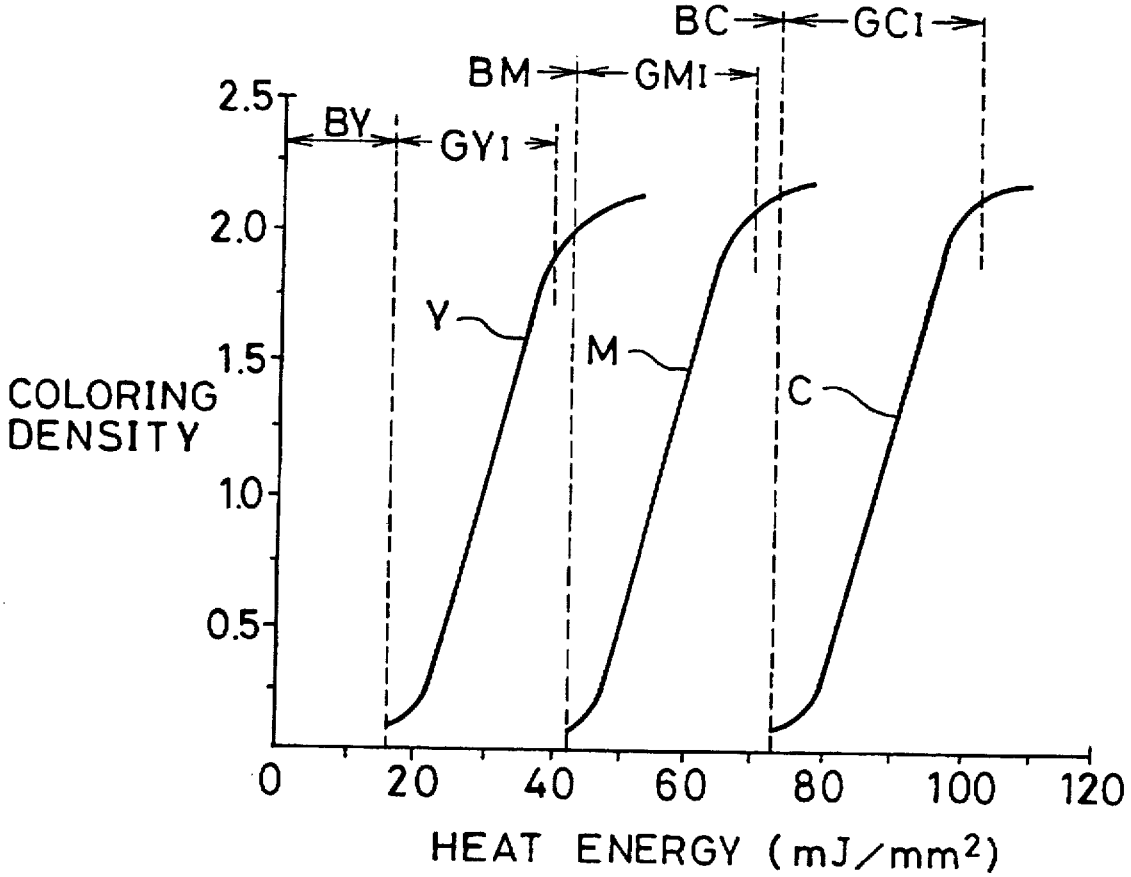
FIG. 3 is a graph showing the coloring characteristics of photosensitive coloring layers.

FIG. 3 illustrates the coloring characteristics of the thermosensitive coloring layers 31 to 33. In this embodiment of the thermosensitive color recording paper 11, the yellow thermosensitive coloring layer 33 requires a lowest coloring heat energy, and the cyan thermosensitive coloring layer 31 requires a highest coloring heat energy. In thermally printing a yellow (Y) pixel, the thermosensitive color recording paper 11 is provided with a coloring heat energy having a predetermined bias heat energy BY added to an image heat energy $GY_I$ determined by a tonal level I of the pixel. The bias heat energy BY is a heat energy required for coloring the yellow thermosensitive coloring layer 33. This is the same for both magenta (M) and cyan (C) pixels, with corresponding reference symbols being given in FIG. 3.

As seen from FIG. 3, the bias heat energy BY is supplied to the thermosensitive color recording paper 11 by driving the heating element of the thermal head 20 with a bias strobe pulse having a pulse width $T_{BY}$. Similarly, the bias heat energies BM and BC are supplied to the thermosensitive color recording paper 11 by driving the heating element with bias strobe pulses having pulse widths $T_{BM}$ and $T_{BC}$, respectively.

Since the cyan thermosensitive coloring layer 31 requires the highest coloring heat energy, it is necessary to heat the cyan thermosensitive coloring layer 31 for a long time and supply a large bias heat energy. On the other hand, the yellow thermosensitive coloring layer 33 requires only a small bias heat energy, and so the yellow thermosensitive coloring layer 33 can be heated in a short time. If the motor drive pulse is generated synchronously with the line start signal, the transport of the thermosensitive color recording paper 11 starts irrespective of the time duration required for the bias heating. Therefore, the positions of printed dots of the respective colors are displaced by the amount corresponding to differences between the bias heating periods. According to the present embodiment this color registration displacement can be substantially eliminated by generating the motor drive pulse at a timing different from the timing of generating the line start signal, for example, at a timing in synchronism with the generation timing of the image bias pulse for the pixel of the first line. Note that, when the density is equal between colors, the registration displacements of color dots can be reduced because the image heating periods are less different between colors at the same density, although the platen drum 10 rotates at a constant speed.

Figure 4:
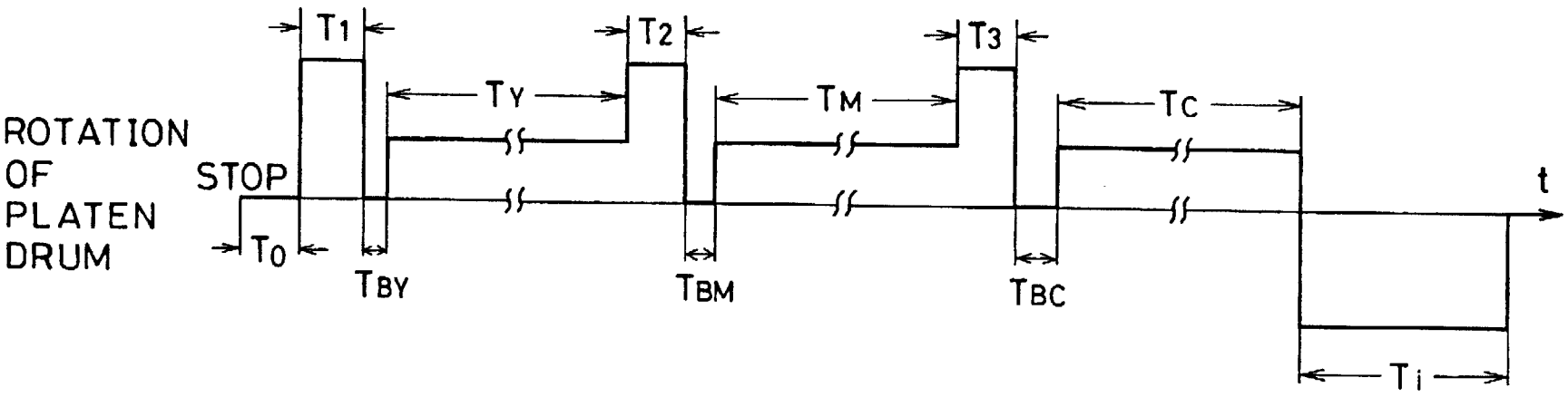
FIG. 4 is a timing chart explaining the rotation of a platen drum.

Referring to FIG. 4 illustrating the rotation operation of the platen drum 10, a time period $T_0$ is a paper feed period which begins with the start of feeding of the thermosensitive color recording paper 11 upon depression of a print start button and which ends when the thermosensitive color recording paper 11 reaches under the position of the clamper 14. During this time period $T_0$, the platen drum 10 halts. A time period $T_1$ is a period which begins when the clamper 14 clamps the leading edge 11*a* of the thermosensitive color recording paper 11 to the circumferential surface of the platen drum 10 and which ends when the front edge of the record area of the thermosensitive recording paper 11 reaches under the thermal head 20.

A time period $T_{BY}$ is a bias heating period for the first line of a yellow image. During the bias heating period, bias strobe pulses are generated and the platen drum 10 halts. A time period $T_Y$ is a period which begins when the first image strobe pulse for the first line of a yellow image is generated and which ends when the last image strobe pulse is generated for the last line. During this period, the yellow image is printed one line after another. In thermally printing each line, one bias strobe pulse and a plurality of image strobe pulses are generated. A time period $T_2$ is a period which begins when the rotation speed of the platen drum 10 is changed to a high speed immediately after the yellow image has been printed and which ends when the record area of the photosensitive color recording paper 11 is transported to the position of the thermal head 20.

A time period $T_{BM}$ is a bias heating period for the first line of a magenta image. During the bias heating period, bias strobe pulses are generated and the platen drum 10 halts. A time period $T_M$ is a period which begins when the first image strobe pulse for the first line of a magenta image is generated and which ends when the last image strobe pulse is generated for the last line. A time period $T_{BC}$ is a bias heating period for a cyan image, the platen drum 10 being stopped during this period. A time period $T_C$ is a cyan image recording period, and $T_i$ is a reverse rotation paper discharge period.

FIG. 5 shows one-line record cycles of three colors. For the convenience of description, the recording cycle and image heating period of each color are assumed to have an equal duration. Generation of the motor drive pulse starts synchronously with the first image strobe pulse generated immediately after the bias strobe pulse of each color, and the platen drum 10 is moved by one line responsive to the four motor drive pulses generated at a predetermined time interval. Accordingly, the time point when the motor drive pulse is generated for the record of the yellow image is upon the lapse of the time period $T_{BY}$ from the line start signal.

Similarly, the time point when the motor drive pulse is generated for the record of the magenta image is upon the lapse of the time period $T_{BM}$ from the line start signal. For the record of the cyan image, the motor drive pulse is generated upon the lapse of the time period $T_{BC}$ from the line start signal. In this manner, the record start positions of the magenta and cyan images are made coincident with that of the yellow image.

Since the platen drum 10 rotates at a constant speed, the recording period of a pixel having a large coloring density becomes long. Therefore, the size of the ink dot becomes slightly longer in the rotation direction of the platen drum 10, resulting in a presence of a small displacement of dot registrations. However, this displacement is so small that it poses no problem in lowering of the image quality. $T_{YK}$ is an image heating period, and $T_{YR}$ is a cooling period.

The operation of the thermal color printer constructed as above will be briefly described. Under the paper feed condition, the platen drum 10 halts with the clamper 14 being set in the vertical direction as viewed in FIG. 1. The transport roller pair 25 nips the thermosensitive color recording paper 11 supplied from a cassette (not shown) and transports the thermosensitive color recording paper 11 toward the platen drum 10. The transport roller pair 25 temporarily stops when the leading edge of the thermosensitive color recording paper 11 reaches under the clamper 14. After the clamper 14 clamps the leading edge of the thermosensitive color-recording paper 11, the platen drum 10 and transport rollers 25 rotate so that the photosensitive color recording paper 11 is wound about the outer periphery of the platen drum 10.

The pulse motor 12 rotates stepwise to move one image line responsive to four pulses. However, the platen drum 10 is belt-driven and rotates substantially at a constant speed. When the front edge of the record area of the thermosensitive color recording paper 11 reaches the thermal head 20 after the time period $T_1$, the platen drum 10 is stopped. The thermal head 20 swings so as not to abut against the clamper 14.

After the platen drum 10 is stopped, the system controller 27 generates a line start signal, and synchronously with this the print controller 29 generates a bias strobe pulse. In this case, all heating elements are supplied with the drive pulse "1" so that they are powered to bias-heat the yellow thermosensitive coloring layer 33.

After the lapse of the time period $T_{BY}$, four motor drive pulses are generated at a predetermined time interval to rotate the platen drum 10 at a constant speed. At the same time, image strobe pulses are generated at a predetermined time interval. Each heating element is powered as many times as that corresponding to the tonal level of each pixel to be printed. In this manner, the first line of the yellow image is thermally printed on the record area of the thermosensitive color recording paper 11.

The system controller 27 generates the line start signal for the second line when the system controller 27 counts up the remaining time period after the start of generating the motor drive pulse. This remaining time period is a time period corresponding to subtraction of the bias heating period (delay time) $T_{BY}$ from the one-line recording period. Similarly, the pulse motor 12 starts rotating when the image heating period starts, and is rotated by four motor drive pulses. The system controller 27 counts the delay time and remaining time period again. This count operation is performed for each line so that the one-line recording period is maintained constant and each line can be printed with a predetermined print width because the print operation is always in synchronism with the line start signal.

When the record area of the yellow image reaches the first light-fixing device 21, the yellow thermosensitive coloring layer 33 is optically fixed by the first light-fixing device 21. The first light-fixing device 21 radiates a near ultraviolet ray of about 420 nm to the thermosensitive color recording paper 11 so that the diazonium salt compound left in the yellow thermosensitive coloring layer 33 is discomposed by light and loses its coloring ability.

After the yellow image is thermally printed and the bottom of the record area is optically fixed by the first-fixing device 21, the rotation of the platen drum 10 is switched to a high speed rotation. When the platen drum 10 makes one revolution to place again the front edge of the record area under the thermal head 20, the system controller 27 generates a line start signal. Synchronously with this line start signal, the print controller 29 generates a bias strobe pulse and the platen drum 10 is stopped for the time period $T_{BM}$. During the halt of the platen drum 10, the thermal head 20 is bias-heated.

After the bias heating period, the image heating period starts. During this period, the print controller 29 generates image strobe pulses at a predetermined time interval. These strobe pulses heat the heating elements as many times as that corresponding to the tonal level of the pixel to be printed. Also during the image heating period, the system controller 27 generates motor drive pulses to start the rotation of the platen drum 10. Similar to the yellow image printing, for the magenta image printing, the line start signal is generated at a predetermined time interval. At the timing of the image heating period, the pulse motor 12 starts rotating to rotate the platen drum 10 at a constant speed. In this manner, the platen drum 10 starts rotating at the timing when actually starting the record of each color image. Accordingly, the record start position of the magenta image is correctly aligned with that of the yellow image.

The thermosensitive color recording paper 11 with the magenta image having been thermally recorded is then optically fixed by the second device 22. In this case, an ultraviolet ray of about 365 nm is radiated from the ultraviolet lamp 22*a* to optically fix the magenta thermosensitive coloring layer 32.

When the platen drum 10 makes one revolution and the record area again reaches the recording position, the one-line recording cycle for the cyan image starts. Also in this case, the platen drum 10 stops during the bias heating period $T_{BC}$. At the image heating period, the rotation of the platen drum 10 starts to thermally print the cyan image of one line. The cyan thermosensitive coloring layer 31 requires a high coloring heat energy which does not allow color to develop in an ordinary custody. Therefore, light fixation is not effected during the thermal printing for the cyan thermosensitive coloring layer 31.

After the thermal printing of the yellow, magenta, and cyan images is completed, the platen drum 10 and transport roller pair 25 are rotated in reverse. With this reverse rotation of the platen drum 10, the trailing edge of the thermosensitive color recording paper 11 is guided to the paper feed/ejection path 24 and nipped by the transport roller pair 25. When the platen drum 10 rotates and reaches the paper ejection position where the clamper 14 is held in the vertical direction as viewed in FIG. 1, the clamp of the leading edge of the thermosensitive color recording paper 11 by the clamper 14 is released, and the rotation of the platen drum 10 is stopped. The thermally recorded thermosensitive color recording paper 11 is ejected via the paper feed/ejection path 24 to a receptacle tray.

In the above embodiment, the printing and paper feeding are synchronized for each line. The printing and paper feed may be synchronized only for the first line, because the pulse rate of motor drive pulses corresponds to a value of the one-line recording cycle divided by four and because the platen drum rotates at a constant speed.

Four motor drive pulses may be generated at a predetermined time interval in the period within the one-line recording cycle. Namely, four motor drive pulses are generated at a predetermined time interval during the period from the beginning of the image heating period to the end of the cooling period, to advance the paper by one line. In this case, obviously the paper feed and printing are required to be synchronized. In printing two adjacent ink dots in one line, four motor drive pulses are generated during the image heating period to rotate the pulse motor by the amount corresponding to one line. In this case, the platen drum is intermittently rotated but at a constant speed.

A direct current (DC) motor may be used instead of a pulse motor. In the case of a DC motor, a different delay time is set for the image record start timing of each color, similar to the above embodiment. After the lapse of each delay time, the rotation of the platen drum starts. After the start of printing, the platen drum is rotated at a constant speed specific to each color by using a servo mechanism, and the ink dots are printed at a predetermined time interval. In this manner, a displacement of color registrations can be avoided.

In the above embodiment, the bias heating period is used as the delay time for the rotation of the platen drum. Instead, the timing of the rotation start of the platen drum can be set to a certain point during the image heating period, e.g., the middle point. A displacement of color registrations can be avoided also in this manner.

If the one-line recording cycle is different for each color, the rotation speed of the platen drum is required to be changed with the one-line recording cycle time. The rotation speed becomes higher for the upper layer (e.g., Y layer) having a shorter cycle time than the lower layer. Therefore, the size of an ink dot recorded on the upper layer becomes larger. Also in this case, by properly setting the delay time for each color, the centers of Y, M, and C ink dots can be made to coincide with each other although the circumferential areas of dots are slightly displaced. It is to be noted that the embodiments of the present invention can be applied effectively to the case where both the image heating period and one-line recording period are different for each color.

In the above embodiment, a recording paper is wound about a rotary platen drum. A recording paper may be placed on a slidable platen which moves linearly. A recording paper may be reciprocally moved by mounting pairs of transport rollers on the front and back of a platen drum.

With a sublimation type thermal printing method, an ink film is placed upon a recording paper and ink contained in the ink film is transferred to the recording paper by heating the rear of the ink film. Although an ink film has a difference between heat sensitivities smaller than a thermosensitive color recording paper, the embodiments of the present invention are also applicable to this method in view of the differences in heat sensitivities between colors. With the sublimation type thermal printing method, the positions of color dots can be therefore aligned more precisely for obtaining a print of a better image quality. If the image heating period differs to a great extent for each color, the same one-line recording cycle and platen drive speed may be used for all Y, M, and C and the delay time for each Y, M, and C is set so as to make the apexes of Y, M, and C ink dots take the same position, thereby obtaining a good image quality without a displacement of color registrations.

The embodiments of the present thermal head and light-fixing devices may be moved relative to a fixed recording paper. The invention are also applicable to a serial printer wherein the relative motion of a recording paper and thermal head is two-dimensional. In this case, after a predetermined delay time, the rotation of a pulse motor starts and the thermal head is moved in the lateral direction (a subsidiary scan direction) along the width of a recording paper. After recording one line (corresponding to the length of a heating element array), the recording sheet is moved in the main scan direction by one line.

Although the present invention has been described with reference to the preferred embodiments shown in the drawings, the invention should not be limited by the embodiments but, on the contrary, various modifications, changes, combinations and the like of the present invention can be effected without departing from the spirit and scope of the appended claims.

I claim:

1. A color thermal printing method for thermally recording a plurality of color images in a plane sequential scheme during a relative motion between a thermal head and a recording paper, said thermal head having a plurality of heating elements disposed in a line in a main scan direction, said color thermal printing method comprising the steps of:

(a) generating a bias heat energy for bias heating a pixel by each of said plurality of heating elements;

(b) generating an image heat energy in accordance with a record density of said pixel following said step (a), to develop color of said pixel at a desired density by adding said bias heat energy and said image heat energy; and (c) starting said relative motion upon starting the generating of said image heat energy at said step (b) or upon a lapse of a predetermined delay time from the starting of the generating said image heat energy at said step (b).

2. A color thermal printing method according to claim 1, wherein said plurality of color images a yellow image, a magenta image, and a cyan image.

3. A color thermal printing method according to claim 1, wherein said recording paper is mounted on a platen drum, said color thermal printing method further comprising the step of rotating said platen drum in a subsidiary scan direction perpendicular to said main scan direction for said relative motion to effect recording of said recording paper one line after another.

4. A color thermal printing method according to claim 3, wherein said platen drum is driven by a pulse motor via a belt.

5. A color thermal printing method according to claim 3, wherein said pulse motor is driven by a pulse having a period, wherein said period is divided by a predetermined integer and is equal to a time required for thermally recording one line of pixels.

6. A color thermal printing method according to claim 3, wherein said platen drum starts moving by an amount corresponding to said one line synchronously with starting the generating of said image heat energy at said step (b).

7. A color thermal printing method according to claim 3, wherein said platen drum starts moving by an amount corresponding to said one line synchronously with substantially a middle point of a period in which said image heat energy is generated at said step (b).

8. A color thermal printing method for thermally recording an image on a recording paper having a plurality of thermosensitive coloring layers formed on a supporting material in a plane sequential scheme, said color thermal printing method comprising the steps of:

(a) heating said thermosensitive coloring layers respectively by using heating elements of a thermal head during a relative motion of said recording paper with said thermal head and a light-fixing light source;

(b) applying ultraviolet rays from said light-fixing light source to optically fix a thermally recorded area;

(c) generating from each of said heating elements image heat energy in accordance with density data of a pixel on each of said thermosensitive coloring layers after generation of bias heat energy specific to each of said thermosensitive coloring layers to thermally record said pixel on each of said thermosensitive coloring layers, wherein said bias heat energy is supplied to said heating elements of said thermal head in common, to develop color of said pixel at a desired density by adding up said bias heat energy and said image heat energy; and (d) starting said relative motion upon starting the generating of said image heat energy at said step (c) or upon a lapse of a predetermined delay time from the starting of the generating of said image heat energy at said step (c) to thermally record said pixel.

9. A color thermal printing method according to claim 8, wherein said heating elements are disposed in a line in a main scan direction.

10. A color thermal printing method according to claim 9, wherein said recording paper is mounted on a platen drum and further comprising the step of rotating said platen drum in a subsidiary scan direction perpendicular to said main scan direction for said relative motion to effect thermal recording of said recording paper one line after another.

11. A color thermal printing method according to claim 10, wherein said platen drum is driven by a pulse motor via a belt.

12. A color thermal printing method according to claim 10, wherein said pulse motor is driven by a pulse having a period, wherein said period is divided by a predetermined integer and is equal to a time required for thermally recording one line pixels.

13. A color thermal printing method according to claim 8, wherein said plurality of thermosensitive coloring layers comprise a yellow thermosensitive coloring layer, a magenta thermosensitive coloring layer, and a cyan thermosensitive coloring layer.

14. A color thermal printing device for thermally recording a plurality of color images in a plane sequential scheme on a recording paper comprising:

a thermal head including a plurality of heating elements disposed in a line in a main scan direction;

bias heat energy generating means for generating a bias heat energy to bias heat a pixel by each of said plurality of heating elements;

image heat energy generating means for generating an image heat energy in accordance with a record density of said pixel following said bias heat energy generated by said bias heat energy generating means, to develop color of said pixel at a desired density by adding said bias heat energy and said image heat energy; and motion starting means for starting a relative motion between said thermal head and the recording paper upon starting the generating of said image heat energy by said image heat energy generating means or upon a lapse of a predetermined delay time from starting generating of said image heat energy from said image heat energy generating means.

15. A color thermal printing device according to claim 14, wherein the plurality of color images comprise a yellow image, a magenta image and a cyan image.

16. A color thermal printing device according to claim 14, further comprising a platen drum for mounting the recording paper thereon and rotating means for rotating said platen drum in a subsidiary scan direction perpendicular to said main scan direction for said relative motion to effect thermally recording the recording paper one line after another.

17. A color thermal printing device according to claim 16, further comprising a pulse motor for driving said platen drum via a belt.

18. A color thermal printing device according to claim 16, wherein said pulse motor is driven by a pulse having a period, wherein said period is divided by a predetermined integer and is equal to a time required for thermally recording one line of pixels.

19. A color thermal printing device according to claim 16, wherein said motion starting means starts to move by an amount corresponding to said one line synchronously with the start of the generating of said image heat energy by said image heat energy generating means.

20. A color thermal printing device according to claim 16, wherein said motion starting means starts to move by an amount corresponding to said one line synchronously with substantially a middle point of a period in which said image heat energy is generated by said image heat energy generating means.

21. A color thermal printing device for thermally recording paper having a plurality of thermosensitive coloring layers formed on a supporting material in a plane sequential scheme comprising:

a thermal head including heating elements for heating the thermosensitive coloring layers respectively during a relative motion of the recording paper with said thermal head and a light-fixing light source;

ultraviolet ray applying means for applying ultraviolet rays from said light-fixing light source to optically fix the thermally recorded area;

image heat energy generating means for generating image heat energy from each of said heating elements in accordance with density data of a pixel on each of the thermosensitive coloring layers after generation of bias heat energy specific to each of said thermosensitive coloring layers to thermally record said pixel on each of said thermosensitive coloring layers, wherein said bias heat energy is supplied to said heating elements of said thermal heat in common, to develop color of said pixel at a desired density by adding said bias heat energy and said image heat energy; and motion starting means for starting said relative motion upon starting the generating of said image heat energy or upon a lapse of a predetermined delay time from the starting of the generating of said image heat energy from said image heat energy generating means to thermally record said pixel.

22. A color thermal printing device according to claim 21, wherein said heating elements are disposed in a line in a main scan direction.

23. A color thermal printing device according to claim 22, further comprising a platen drum for mounting the recording paper thereon and rotating means for rotating said platen drum in a subsidiary scan direction perpendicular to said main scan direction for said relative motion to effect thermally recording the recording paper one line after another.

24. A color thermal printing device according to claim 23, further comprising a pulse motor for driving said platen drum via a belt.

25. A color thermal printing device according to claim 23, wherein said pulse motor is driven by a pulse having a period, wherein said period is divided by a predetermined integer and is equal to a time required for thermally recording one line of pixels.

26. A color thermal printing device according to claim 21, wherein the plurality of thermosensitive coloring layers comprise a yellow thermosensitive coloring layer, a magenta thermosensitive coloring layer and a cyan thermosensitive coloring layer.

* * * * *